US008482201B2

(12) United States Patent
Krajka et al.

(10) Patent No.: US 8,482,201 B2
(45) Date of Patent: Jul. 9, 2013

(54) GAS DISCHARGE LAMP

(75) Inventors: Marcin Krajka, Uhldingen-Mühlhofen (DE); Rolf Disch, Eichstetten (DE)

(73) Assignee: Sick AG, Waldkirch (DE)

( * ) Notice: Subject to any disclaimer, the term of this patent is extended or adjusted under 35 U.S.C. 154(b) by 323 days.

(21) Appl. No.: 12/963,932

(22) Filed: Dec. 9, 2010

(65) Prior Publication Data

US 2011/0148294 A1 Jun. 23, 2011

(30) Foreign Application Priority Data

Dec. 18, 2009 (DE) ..... 10 2009 059 705

(51) Int. Cl.
*H01J 17/04* (2012.01)

(52) U.S. Cl.
USPC ..... 313/621; 313/152

(58) Field of Classification Search
USPC ..... 313/152, 156, 161, 621, 631
See application file for complete search history.

(56) References Cited

U.S. PATENT DOCUMENTS 3,914,054 A 10/1975 Hadeishi
5,013,966 A 5/1991 Saikatsu et al.
2002/0021564 A1 2/2002 Cho et al.
2003/0052611 A1 3/2003 Yamamoto et al.
2004/0178731 A1 9/2004 Takeda et al.
2004/0256968 A1* 12/2004 Kurita et al. ..... 313/234
2005/0189879 A1 9/2005 Minamoto et al.

FOREIGN PATENT DOCUMENTS

EP 0 948 030 A2 10/1999
WO 2008/129481 A2 10/2008

OTHER PUBLICATIONS

German Examination Report, dated Sep. 10, 2010, four (4) pages.

* cited by examiner

*Primary Examiner* — Anne Hines
(74) *Attorney, Agent, or Firm* — Nath, Goldberg & Meyer; Jerald L. Meyer

(57) ABSTRACT

The invention relates to a gas discharge lamp with a gas discharge tube having a cylindrical discharge region and having two electrodes which are arranged at an outer side of the gas discharge tube. To achieve an improved gas discharge tube having external electrodes with an increased lifetime it is proposed that each electrode has a planar disc shaped holding section which each have a respective opening and in that the cylindrical discharge region is received in the openings in a shape matched manner, wherein the cylinder axis of the cylindrical discharge region lies perpendicular to the planar holding sections.

7 Claims, 4 Drawing Sheets

12

GAS DISCHARGE LAMP

Figure 1:
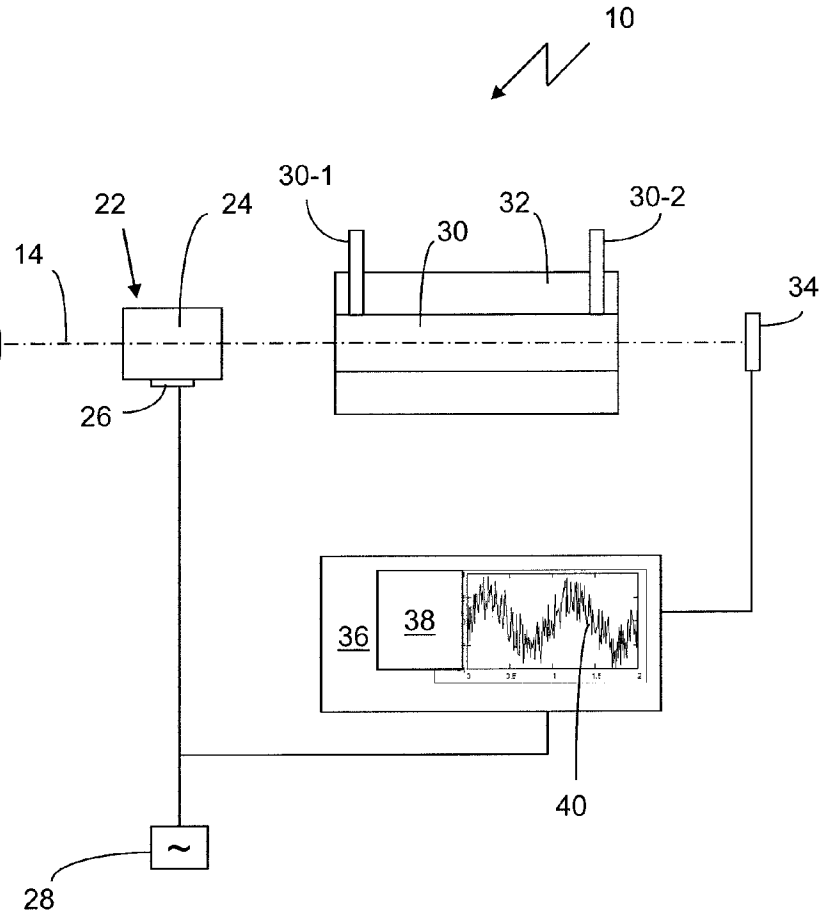

The invention relates to a gas discharge lamp in accordance with the preamble of claim 1, as well as to a light source having such a gas discharge lamp which preferably serves as a mercury spectral lamp.

From U.S. Pat. No. 5,013,966 a type of gas discharge lamp having external electrodes is known. In this the electrodes are formed as ring electrodes and respectively surround a cylindrical section of the gas discharge tube. In this respect the ring electrodes have a relatively large surface area and are formed as a type of clamp. The limited life time is common for all known gas discharge lamps which results, in particular due to a blacking of the inner side of the discharge tube. This is particularly true for mercury lamps, presumably because the mercury ions are impinged into the quartz glass surface of the discharge tube and react there to become mercury oxide. This procedure is ever more effective the higher the speed is with which the ions impinge in the surface. The speed depends on the electric field perpendicular to the surface.

Starting from this prior art it is the object of the invention to provide an improved gas discharge lamp having external electrodes which has a higher life time.

This object is satisfied by a gas discharge lamp having the features of claim 1.

The gas discharge lamp in accordance with the invention includes a gas discharge tube having a cylindrical discharge region and two electrodes which are arranged at an outer side of the gas discharge tube, wherein each electrode has a planar disc-shaped holding section which each have respective openings and wherein the cylindrical discharge region is received in the openings in a shape matched manner, wherein the cylinder axis of the cylindrical discharge region lies perpendicular to the planar holding sections.

It has been shown that considerably less blacking is present on the inner side of the gas discharge tube when the electrodes are designed in a manner in accordance with the invention and only a small region of electrode, namely the inner sides of the boundary of the openings are in contact with the gas discharge tube. Through this the life time is also considerably increased. Experiments with mercury spectral lamps in which comparison measurements were made between identical gas discharge tubes but with different electrode formations namely, on the one hand, those known from the prior art in which the electrodes surround a cylindrical gas discharge tube in a clamping manner and, on the other hand, those having the design in accordance with the invention which have shown that the life time can be increased by more than a factor of 6. A possible part of the explanation for this long life time is presumably that the electro-magnetic field which is formed between the planar holding section with this specific geometry, i.e. flat discs, which discs are arranged parallel to one another and the arrangement of the gas discharge tube perpendicular thereto contribute thereto so that a reduced blacking occurs.

In a different embodiment material thicknesses of the holding sections of approximately 0.15 mm and a separation distance of the holding sections of approximately 3 mm have been found to be particularly advantageous.

In particular, in the use of a gas discharge lamp as a mercury spectral lamp the Zeeman components of the spectral lines are frequently required, so that the invention also includes a light source surrounding the gas discharge lamp in accordance with the invention, wherein magnets are provided between which a generally homogenous magnetic field can be generated.

So that the generated magnetic field is particularly homogenous in one embodiment of the light source in accordance with the invention it is provided that a north pole of a magnet is arranged at a side of the gas discharge tube and a south pole of a second magnet is arranged at the opposite side and in that both the north pole and also the south pole are formed from two partial magnets, whose like poles are arranged opposite one another and form the north pole and the south pole respectively, wherein a gap is formed between the opposing two north poles and between the opposing two south poles which gaps widen towards the gas discharge tube. A further increase of homogeneity can be achieved when the gaps are each filled with an iron core, wherein the shape of the end of the iron core facing the gas discharge tube is preferably formed in a concave shape.

In a different embodiment of the light source the magnets are arranged on opposite sides of the gas discharge tube and are formed as ring magnets whose one pole is arranged at the inner boundary and the other pole is arranged at the outer boundary. Such ring magnets are available on the market and can be supported in the light source in a constructively simple manner, so that the light source can be designed in a relatively simple manner in comparison to the previously mentioned embodiment.

On use of the gas discharge lamp in accordance with the invention as a mercury spectral lamp, the gas discharge tube is preferably composed from a quartz glass. Such a mercury spectral lamp is preferably used for the measurement of the mercury concentration of a gas.

Figure 2:
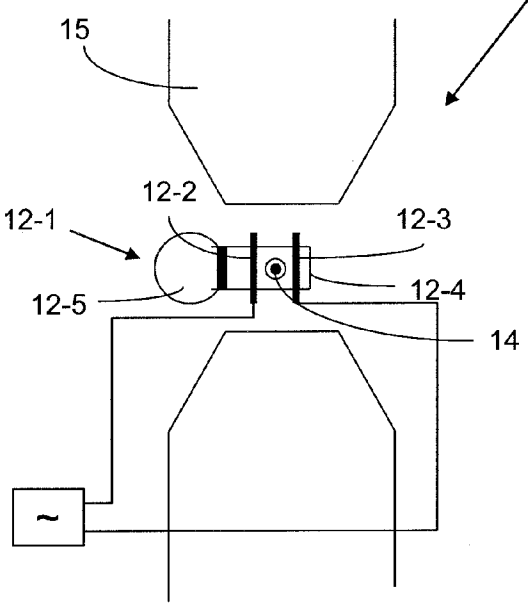
Figure 4:
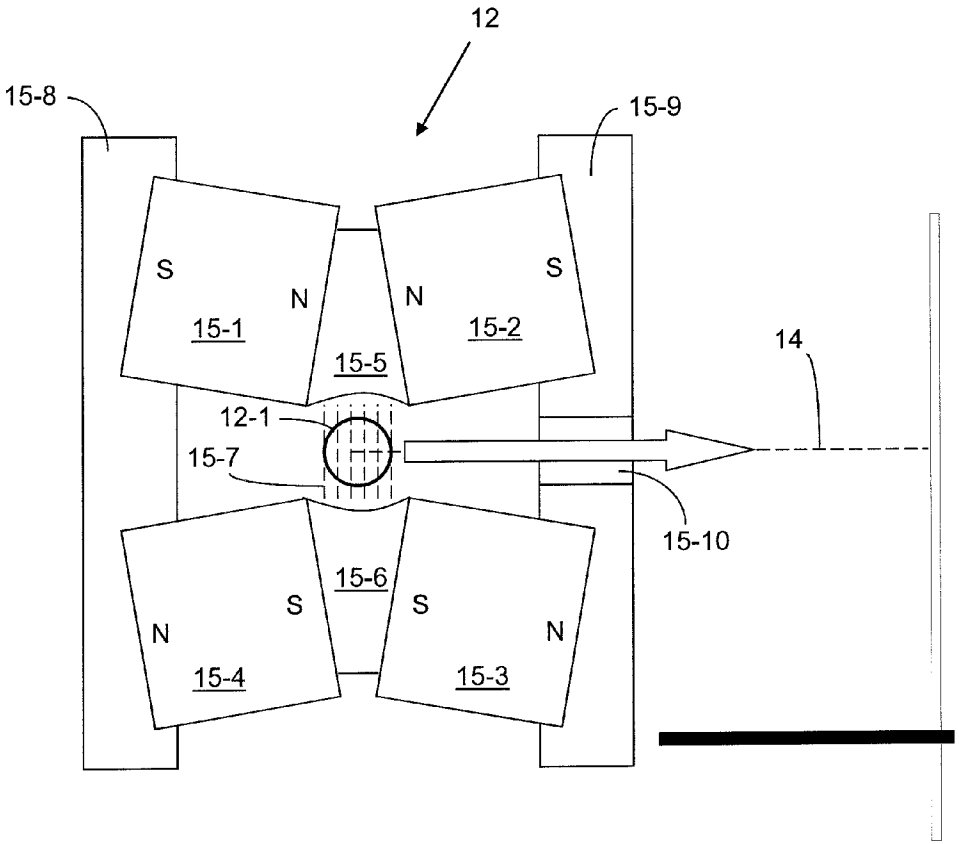
Figure 3:
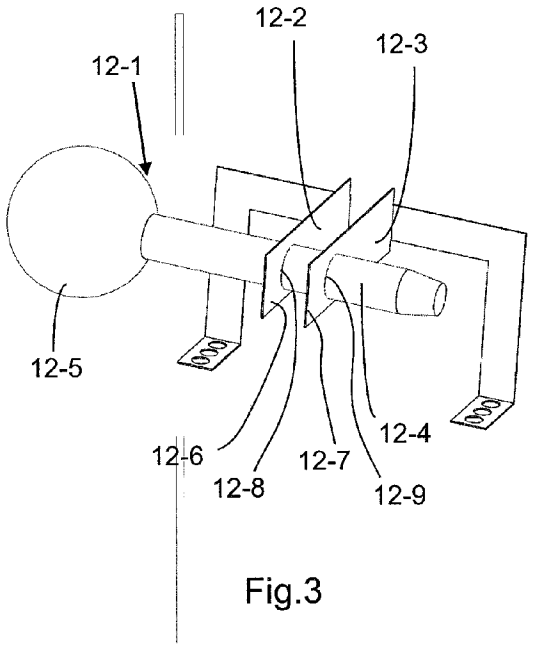
Figure 5:
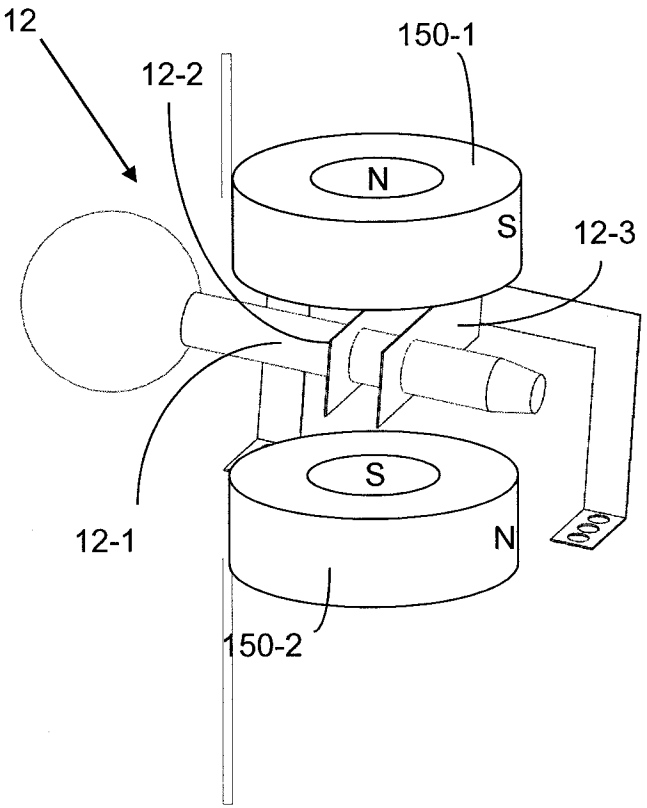
Figure 6:
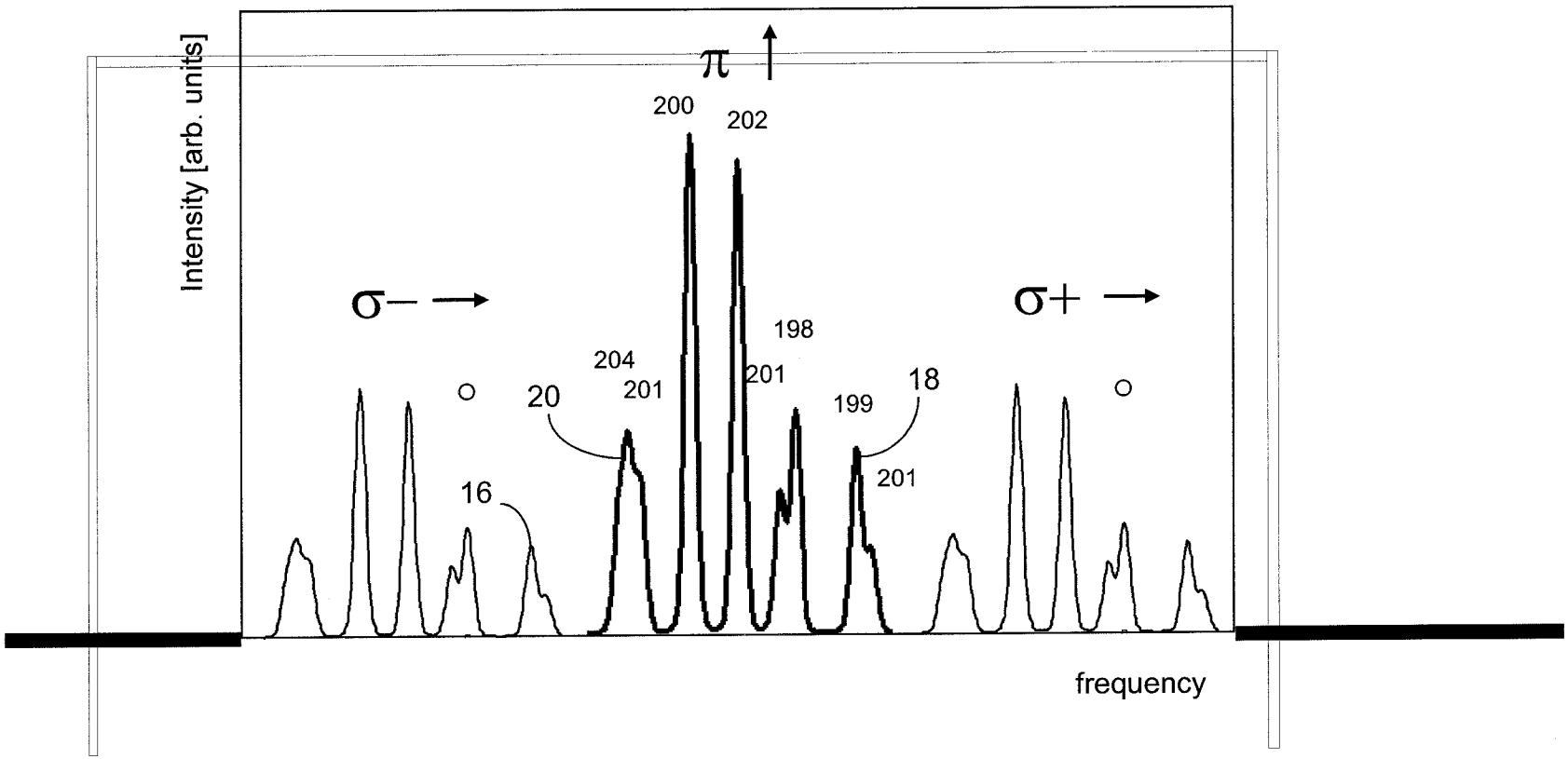

In the following the invention will be described in detail by means of the drawing with reference to an embodiment. In the drawing there is shown:

FIG. 1 a schematic illustration of an apparatus for the measurement of a concentration of a material in a gas, the apparatus having the light source in accordance with the invention;

FIG. 2 is a schematic and slightly more detailed illustration of the light source in accordance with the invention of FIG. 1;

FIG. 3 a gas discharge lamp in accordance with the invention in perspective view;

FIG. 4 a further detailed illustration of the light source having a gas discharge lamp in cross-section;

FIG. 5 a different embodiment of the light source having the gas discharge lamp;

FIG. 6 a mercury spectrum of the light source.

As is illustrated schematically in FIG. 1, an apparatus 10 for the measurement of a mercury content in a gas has a light source 12 in accordance with the invention for the emission of mercury spectral lines along an optical axis 14.

The light source 12 in accordance with the invention, which is shown in FIG. 2 in more detail, but is still schematically illustrated, is formed as an electrode-less gas discharge lamp and includes a gas discharge tube 12-1 in which the gas discharge burns. In FIG. 2 the light source is illustrated such that the optical axis 14 is perpendicular to the plane of the drawing.

As can be recognized, in particular from FIG. 3, the gas discharge tube 12-1 has a cylindrical discharge region 12-4 and a spherical section 12-5. In the spherical section 12-5 a mercury supply is present, so that in the gas discharge the mercury spectral lines can arise. The mercury is preferably mercury having a natural isotope distribution. The gas discharge is ignited and maintained by two electrodes 12-2 and 12-3 which are arranged at the cylindrical discharge region 12-4 outside of the discharge tube 12-1. Typically a high frequency voltage having a frequency of approximately 200 to 250 MHz and an amplitude of 4 to 8 V is applied to the electrodes 12-2 and 12-3.

Each electrode 12-2 and 12-3 in accordance with the invention has a planar disc-shaped holding section 12-6 and 12-7 which have respective openings 12-8 and 12-9. The cylindrical discharge region 12-4 of the gas discharge tube 12-1 is held in a shape matched manner in the openings 12-8 and 12-9. The holding sections 12-6 and 12-7 are arranged in parallel to one another and with its cylinder axis the cylindrical discharge region 12-4 lies perpendicular to the holding section 12-6 and 12-7.

In the embodiment the holding sections 12-6 and 12-7 have a material thickness of approximately 0.15 mm and are separated by distances of approximately 3 mm. They are preferably made of copper as a good electrical conductor.

The gas discharge tube 12-1 of the light source 12 is located in as homogeneous a magnetic field as possible which is generated by magnets 15 and which is aligned perpendicular to the optical axis at the position of light generation. Due to the Zeeman effect the σ+ Zeeman components, the σ− Zeeman components and the Π polarized Zeeman components of the spectral lines are generated in this way.

So that the splitting of the spectral lines is large enough and the spectral lines remain clear enough, i.e. are spectrally displaced at each position in the lamp by the same amount a sufficiently strong and homogeneous magnetic field has to be generated. For this reason the magnet 15 is formed in a particular manner, as is shown in FIG. 4. The magnet 15 which generates the homogenous magnetic field is built up from a total of four individual magnets 15-1 to 15-4, so that a north pole is arranged on one side of the gas discharge tube 12-1 (above the gas discharge tube in FIG. 4) and a south pole is arranged on the opposite side (below the gas discharge tube in FIG. 4). The north pole of the magnet 15 is then formed by the two partial magnets 15-1 and 15-2 whose north poles lie opposite one another. In a corresponding manner the south pole of the magnet 15 is formed by the two south poles of the partial magnets 15-3 and 15-4. A respective gap is formed between the opposing two north poles of the partial magnets 15-1 and 15-2, as well as between the opposing south poles of the partial magnets 15-3 and 15-4, which gaps widen towards the gas discharge tube 12-1. Both gaps are preferably filled with an iron core 15-5 and 15-6, wherein the shape of the ends of the iron core which is facing the gas discharge tube 12-1 is formed in the illustrated section concavely. Through this embodiment of the magnet 15 with its partial magnets and the iron cores a particularly homogenous magnetic field can be generated at the position of the gas discharge which is indicated by the dotted lines 15-7.

From the outside the magnets 15-1 to 15-4 are held by supports 15-8 and 15-9 which are preferably made of iron, to guide the magnetic field between the partial magnets 15-1 and 15-4 and/or 15-2 and 15-3 in a suitable manner. The support 15-9 has an opening 15-10 through which the light generated in the gas discharge tube 12-1 can exit out and arrive at the apparatus 10 along the optical axis 14.

FIG. 6 shows a mercury spectrum generated by the gas discharge lamp 12. The spectral lines which are printed fatter correspond to the Π component, wherein the individual spectral lines of the Π component correspond to the different transitions of the different isotopes. The individual lines are marked by the respective mass number of the isotope. The spectral lines of the σ+ components lie at higher frequencies and the spectral lines of the σ− components lie at lower frequencies. The magnetic field at the position of the gas discharge is so strong, so that the spectral distribution of the σ+ components and of the σ− components do not intersect with the distribution of the Π components. Typically the magnetic field is approximately 1 to 1.5 Tesla. This means that, for example, the spectral line of the σ− component of $^{199}$Hg which is referred to using the reference numeral 16 and which corresponds to the spectral line of the Π component having the highest energy which is further referred to using the reference numeral 18 is displaced to lower frequencies so far such that it is significantly separated from the spectral line of the Π component which is referred to using the reference numeral 20 and which corresponds to the spectral line having the lowest energy of the Π component, i.e. the spectral line of $^{204}$Hg.

As will be explained in more detail in the following the sufficient separation is important because the Π component ultimately delivers the measurement quantity, since the non-displaced Π component is absorbed and the displaced a components form a reference value as the displaced spectral components cannot be absorbed as was principally already known from the prior art (U.S. Pat. No. 3,914,054).

Finally, FIG. 5 also shows a different embodiment of the light source 12 in accordance with the invention for the generation of Hg spectral lines. The gas discharge tube 12-1, as well as the electrodes 12-2 and 12-3 are designed like those shown in the previous embodiment. However, the magnets are now formed as ring magnets 150-1 and 150-2 and are arranged at opposite sides of the gas discharge tube 12-1. The north pole of the one ring magnet 150-2 is located at the outer boundary of the ring and the corresponding south pole is located at the inner side and vice versa for the other magnet 150-1. In this way a relatively homogeneous magnetic field is generated at the position of the gas discharge with the aid of two simple ring magnets. FIG. 5 does not represent a true to scale illustration of the set-up, but merely indicates the set-up schematically. In particular, the separation of the two ring magnets 150-1 and 150-2 to one another is not shown true to scale.

In the following the use of the gas discharge lamp in accordance with the invention in the apparatus 10 for the determination of the mercury content of a gas is individually explained for a complete understanding.

The light generated in the light source 12 includes the Zeeman components of the mercury spectral lines in accordance with FIG. 6 as was already mentioned.

The light then runs through an optical separator device 22 which is formed as a photo-elastic modulator 24 here, in which the birefringent properties of the modulator 24 influence the linear polarized Π components differently compared to the polarized σ+ components and to the σ− components perpendicular thereto. This difference in influence is achieved in synchronism to the rhythm of an alternating voltage which is applied to the piezo 26 which is supplied by a voltage source 28. In combination with the photo-elastic modular 24 having a polarizer which is not illustrated in detail, on the one hand, the polarization of the signal components is turned and at certain times only the σ+ components and the σ− components are let through and at other times only the Π components are let through. Thus, with the aid of the photo-elastic modulator 24 a timely separation of the Π component, on the one hand, and of the σ+ component and of the σ− component on the other hand is achieved.

Following this the light passes through a measurement cell 30 containing the mercury contaminants to be measured therein. The measurement cell could also, have a heating 32. The non-displaced spectral lines of the Π component experience an absorption at the mercury atoms in the measurement cell 30, in contrast to which the displaced σ+ components and the displaced σ− components do not experience an absorption due to the energy displacement so that the light of these lines serves as a reference light.

Finally, the light is received at the light receiver 34 and guided to a lock-in amplifier 38 which is triggered by the alternating voltage conveyed to the photo-elastic modulator 24. As a result a signal is then generated via the lock-in amplifier as is qualitatively shown with the reference numeral 40 in FIG. 1. I.e. the light receiver 34 alternatively receives reference light and the non-absorbed part of the measurement light having a frequency corresponding to that of the modulator voltage, so that the difference thereof, i.e. the amplitude of the curve 40 is a measure for the absorption in the measurement cell 30 and thus a measure for the mercury concentration, so that from this signal the concentration of mercury in the gas to be investigated can be determined.

LIST OF REFERENCE NUMERALS

10 apparatus
12 light source, gas discharge lamp
12-1 discharge tube
12-2 and 12-3 electrode
12-4 cylindrical discharge region
12-5 spherical section
12-6 and 12-7 disc shaped holding section
12-8 and 12-9 opening
14 optical axis
15 magnet
15-1 to 15-4 partial magnet
15-5 to 15-6 iron cores
15-7 magnetic field lines
15-8 and 15-9 support
15-10 opening
16, 18, 20 spectral lines
22 optical separator device
24 modulator
26 piezo
28 voltage supply
30 measurement cell
32 heater
34 light receiver
36 lock in amplifier
40 signal
150-1 and 150-2 ring magnets

The invention claimed is:

1. A gas discharge lamp with a gas discharge tube (12-1) having
- a cylindrical discharge region (12-4) with a cylinder axis, and
- having two electrodes (12-2, 12-3) which are arranged at an outer side of the gas discharge tube (12-1),
  - wherein each electrode (12-2, 12-3) has a planar disc shaped holding section (12-6, 12-7) which each have a respective opening (12-8, 12-9), and
  - wherein the cylindrical discharge region (12-4) is received in the openings (12-8, 12-9) in a shape matched manner and the cylinder axis lies perpendicular to the planar holding sections (12-6, 12-7).

2. A gas discharge lamp in accordance with claim 1 wherein the holding section (12-6, 12-7) has a material thickness of approximately 0.15 mm and the holding sections (12-6, 12-7) of the two electrodes (12-2, 12-3) are separated by approximately 3 mm.

3. A light source having a gas discharge lamp (12) with a gas discharge tube (12-1) having
- a cylindrical discharge region (12-4) with a cylinder axis, and
- two electrodes (12-2, 12-3) which are arranged at an outer side of the gas discharge tube (12-1),
  - wherein each electrode (12-2, 12-3) has a planar disc shaped holding section (12-6, 12-7) which each have a respective opening (12-8, 12-9), and
  - wherein the cylindrical discharge region (12-4) is received in the openings (12-8, 12-9) in a shape matched manner wherein and the cylinder axis lies perpendicular to the planar holding sections (12-6, 12-7),
- the gas discharge lamp (12) further having magnets (15, 15-1 to 15-4, 150) disposed about the gas discharge tube (12-1) generating a generally homogenous magnetic field (15-7).

4. A light source in accordance with claim 3 wherein a north pole of a magnet is arranged on one side of the gas discharge tube and a south pole of a second magnet is arranged on the opposite side and wherein both the north pole and also the south pole are formed from two partial magnets (15-1 and 15-2 alternatively 15-3 and 15-4) whose like poles lie opposite one another and form the north pole and the south pole respectively, wherein a gap is formed between each of the two opposite north poles or opposite south poles which gap widens towards the gas discharge tube (12-1).

5. A light source in accordance with claim 4 wherein the gaps are respectively filled with an iron core (15-5, 15-6), wherein the shape of the end of the iron core facing the gas discharge tube (12-1) is preferably concavely designed.

6. A light source in accordance with claim 4 wherein the magnets are arranged on opposite sides of the gas discharge tube (12-1) and are formed as ring magnets (150-1 and 150-2) whose one pole lies at the inner boundary and the other pole lies at an outer boundary.

7. A mercury spectral lamp having a light source formed from a gas discharge lamp (12) with a gas discharge tube (12-1) having
- a cylindrical discharge region (12-4) with a cylinder axis, and having
- two electrodes (12-2, 12-3) which are arranged at an outer side of the gas discharge tube (12-1),
  - wherein each electrode (12-2, 12-3) has a planar disc shaped holding section (12-6, 12-7) which each have a respective opening (12-8, 12-9) and
  - wherein the cylindrical discharge region (12-4) is received in the openings (12-8, 12-9) in a shape matched manner wherein and the cylinder axis of the cylindrical discharge region (12-4) lies perpendicular to the planar holding sections (12-6, 12-7),
- the gas discharge lamp (12) further having magnets (15, 15-1 to 15-4, 150) disposed about the gas discharge tube (12-1) generating a generally homogenous magnetic field (15-7), and wherein the gas discharge tube (12-1) is composed of a quartz glass and includes mercury.

* * * * *

UNITED STATES PATENT AND TRADEMARK OFFICE

CERTIFICATE OF CORRECTION

PATENT NO. : 8,482,201 B2
APPLICATION NO. : 12/963932
DATED : July 9, 2013
INVENTOR(S) : Marcin Krajka et al.

It is certified that error appears in the above-identified patent and that said Letters Patent is hereby corrected as shown below:

In the Claims

- Claim 3, column 6, Line 15; between "manner" and "and"

Please delete "wherein".

- Claim 7, column 6, Line 53; between "manner" and "and"

Please delete "wherein".

Signed and Sealed this
Twelfth Day of November, 2013

Teresa Stanek Rea

Teresa Stanek Rea
*Deputy Director of the United States Patent and Trademark Office*